US005920990A

United States Patent [19]

Mooney

[11] Patent Number: 5,920,990

[45] Date of Patent: Jul. 13, 1999

[54] WIRE CUTTING TOOL WITH INTEGRAL HOLDING MEANS

[75] Inventor: Arthur J. Mooney, Sparta, Tenn.

[73] Assignee: H&M Enterprises, Inc., Sparta, Tenn.

[21] Appl. No.: 09/017,117

[22] Filed: Jan. 31, 1998

[51] Int. Cl.[6] ..... B25B 7/22

[52] U.S. Cl. ..... 30/124; 30/123; 30/134; 30/186

[58] Field of Search ..... 30/123, 112, 124, 30/186, 134, 135

[56] References Cited

U.S. PATENT DOCUMENTS

| | | | |
|---|---|---|---|
| 318,006 | 5/1885 | Martin | 30/123 |
| 1,894,329 | 1/1933 | Tallmadge | 30/124 |
| 2,103,597 | 12/1937 | Ravenscroft | 30/124 |
| 2,814,869 | 12/1957 | Matson | 30/124 |
| 2,985,957 | 5/1961 | Freedman | 30/124 |
| 3,181,181 | 5/1965 | Buckley et al. | 30/123 |
| 3,456,343 | 7/1969 | Breisch . | |
| 3,722,093 | 3/1973 | Kaufman | 30/124 |
| 3,740,844 | 6/1973 | Rubin | 30/124 |
| 3,763,560 | 10/1973 | Makkay et al. | 30/124 |
| 3,777,398 | 12/1973 | Routh, Jr. | 30/124 |
| 3,842,500 | 10/1974 | Cassel | 30/124 |
| 3,872,528 | 3/1975 | Porter | 30/124 |
| 3,908,268 | 9/1975 | Brown | 30/124 |
| 4,092,774 | 6/1978 | Watts | 30/112 |
| 4,247,983 | 2/1981 | Jansson et al. | 30/124 |
| 4,326,334 | 4/1982 | Roux | 30/124 |
| 4,404,746 | 9/1983 | Jansson et al. | 30/124 |

*Primary Examiner*—M. Rachuba
*Assistant Examiner*—Sean Pryor
*Attorney, Agent, or Firm*—Joseph A. Marasco

[57] ABSTRACT

A wire cutting tool includes a jaw defining a cutting edge and at least one cavity disposed in sufficient proximity to the cutting edge so that a wire being cut by the cutting edge is swaged into the cavity and held therein after the wire has been cut.

6 Claims, 2 Drawing Sheets

WIRE CUTTING TOOL WITH INTEGRAL HOLDING MEANS

FIELD OF THE INVENTION

The present invention relates to wire cutting tools adapted for holding cut end of wire after cut has been made, and more particularly to wire cutting tools having integral wire holding means which operates by deforming the cut end of the wire into a cavity defined by a jaw of the wire cutter.

BACKGROUND OF THE INVENTION

Conventional wire cutters, when used to cut a short piece from the end of a wire, tend to allow the cut end to either be forcibly propelled away or fall. There is a long-standing need in electrical, electronics, surgical, and space (zero gravity) applications for wire cutting devices which hold the cut end of wire, preventing the same from being propelled away or from falling or floating into undesirable places, for example, the interior of electrical and/or electronic equipment, spacecraft and other vehicles, living patients, and the like.

Wire cutting tools have been devised for holding cut ends, but require add-on features and parts, and often release the wire when the tool is opened.

OBJECTS OF THE INVENTION

Accordingly, objects of the present invention include the provision of a new and improved wire cutting device which holds the cut end of wire, even after the cutting device is opened, preventing the wire from being propelled away or from falling into undesirable places, while requiring no add-on features or parts.

Further and other objects of the present invention will become apparent from the description contained herein.

SUMMARY OF THE INVENTION

In accordance with one aspect of the present invention, the foregoing and other objects are achieved by a wire cutting tool which includes a jaw defining a cutting edge and at least one cavity disposed in sufficient proximity to the cutting edge so that a wire being cut by the cutting edge is swaged into the cavity and held therein after the wire has been cut.

In accordance with another aspect of the present invention, a wire cutting tool includes a first jaw and an opposing second jaw, the second jaw defining a cutting edge and a cavity disposed in sufficient proximity to the cutting edge so that a wire being cut by and between the first jaw and the cutting edge is swaged into the cavity and held therein after the wire has been cut.

For a better understanding of the present invention, together with other and further objects, advantages and capabilities thereof, reference is made to the following disclosure and appended claims in connection with the above-described drawings.

DETAILED DESCRIPTION OF THE INVENTION

Figure 1:
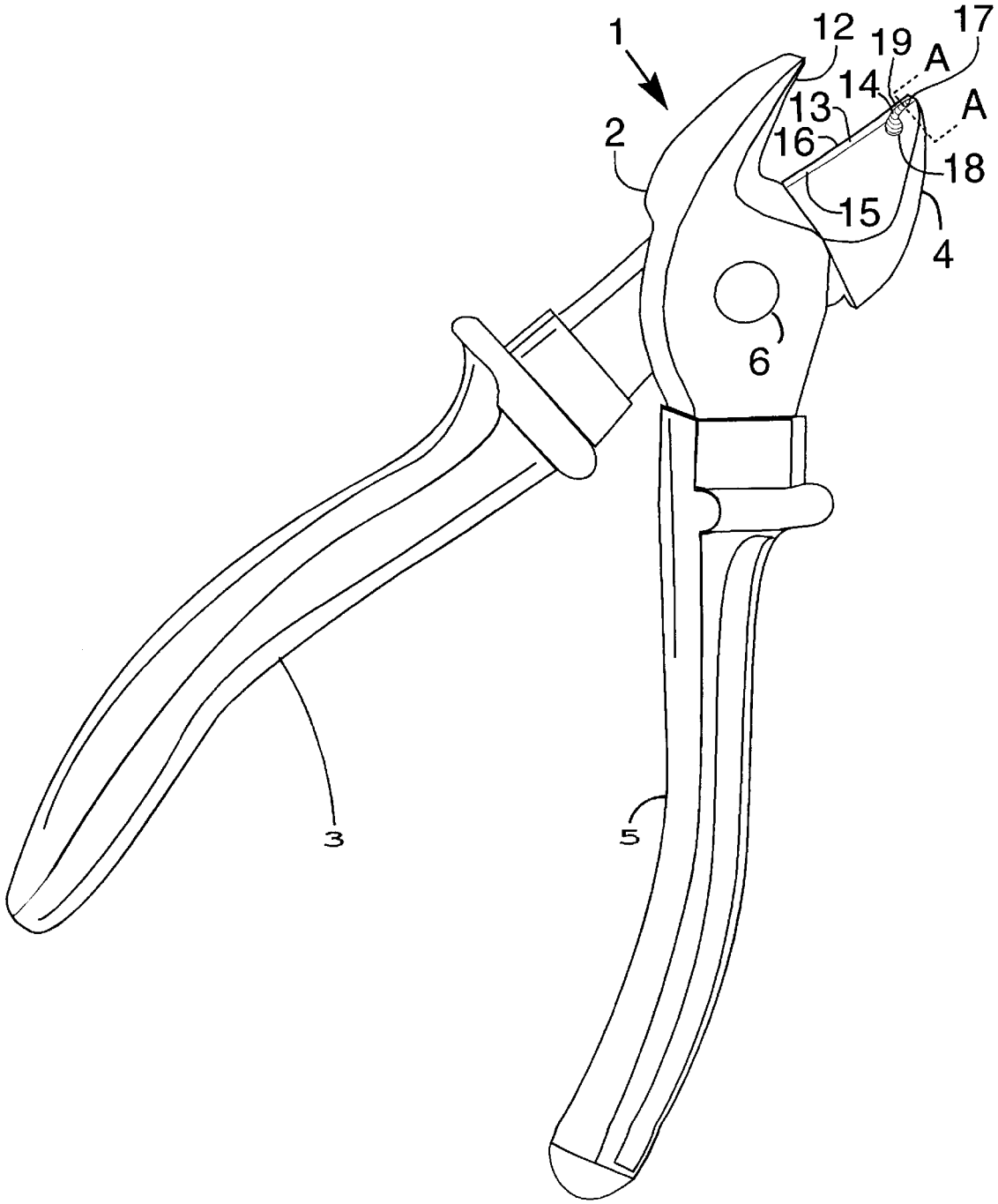
FIG. 1 is an oblique view of a wire cutting tool having integral wire holding means in accordance with an embodiment of the present invention.

Referring now to FIG. 1, a wire cutting hand tool 1 generally comprises a wire cutting pliers having integral means for holding cut end of wire after cut has been made. Handles 3, 5 pivot about fulcrum 6 to open and close jaws 4, 2. A first jaw 2 of the tool is of a conventional configuration, having a conventional cutting edge or anvil 12. A second jaw 4 defines at least one cavity 14 which defines and functions as an integral holding means as described further hereinbelow.

A cutting face 13 is defined as the narrow, angled region of the tool which generally forms one side of a cutting edge 16. Wire which is cut by the cutting edge 16 is deformed against the cutting face 13. The first jaw 2 generally also has a cutting face, not seen in FIG. 1 due to the angle of the view.

Operation of the invention is generally in the following fashion. A wire is placed between the jaws 4, 2 in an orientation so that the end to be cut off is on the same side of the jaws 4, 2 as the cutting face 13. The handles 3, 5 are squeezed so that the jaws 4,2 close upon the wire at the cavity 14, cutting the wire. The cutting action swages (deforms and presses) the wire end being cut off against the face 13 and into the cavity 14 sufficiently to be retained therein until manually removed. Thus, the invention keeps cut ends from falling into undesirable places as wires are cut.

Figure 2:
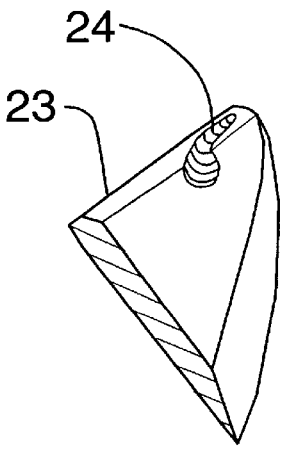
FIGS. 2–4 are partial oblique views of wire cutting tools having integral wire holding means in accordance with various embodiments of the present invention.
Figure 3:
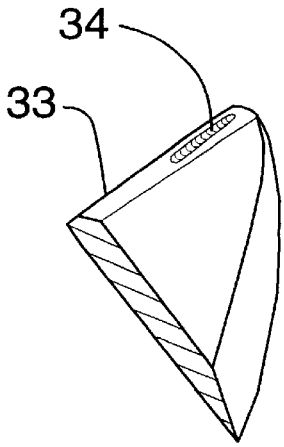

A cavity which functions as described hereinabove may be characterized by various shapes and configurations. As shown in FIGS. 1–3, in jaws 4, 23, 33, respectively, a cavity 14, 24, 34 is generally elongated. As shown in FIGS. 1 and 2, a cavity 14, 24 may be curved. As shown in FIG. 3 a cavity 34 may be straight. As shown in FIGS. 1 and 2, a cavity 14, 24 may extend into the jaw 4 beyond the cutting face 13 away from the cutting edge 16. The cavity 14 may also have a small end 17 and a large end 18 as shown in FIG. 1.

The depth of the cavity is generally in the range of about 0.5 to about 1.0 of the width thereof, but can be varied to optimize a particular configuration.

The cavity is disposed in sufficient proximity to said cutting edge for the swaging action to take place. The cutting face 13 defines a small isthmus 19 which separates the cavity 14 from the cutting edge 16. The minimum isthmus 19 width is defined as that beyond which the cavity 14 becomes so close to the cutting edge 16 that the metal becomes too thin to support the integrity of the cutting edge 16.

The maximum isthmus 19 width is defined as that wherein the cavity is not disposed in sufficient proximity to said cutting edge for the swaging action to take place. If the cavity is too far away from the cutting edge, an insufficient amount of swaging into the cavity will result in the wire not remaining in the cavity. An optimized isthmus width is contemplated to be in the range of about 0.3–0.8 average cavity width, but can vary, depending on wire size and composition, and insulation thickness and composition.

The cavity 14 is shown about actual size, about ¼ inch long, about 1/20 inch wide and 1/32 inch deep at the small end 17, and about ⅛ inch wide and about 3/32 deep at the large end 18. The tool is suitable for cutting and holding nos. 8–12 copper and aluminum wire, and various sizes of plastic string and tubing.

The present invention is most suitable for use with various types of solid or multiple strand conductor electrical wire, including bare or insulated wire of various metals, especially softer metals such as copper, aluminum, silver, and nickel. Harder metal wire, such as steel, will be more difficult to swage into a cavity. The thickness and composition of insulating material may also have an effect on the operation of the invention.

The present invention is also suitable for non-metal applications such as plastic and/or polymer weed cutting string, tubing, and the like. Therefore the term "wire" is to be construed to mean any of the foregoing.

The second jaw 4 may also have a conventionally configured region 15 without a cavity to facilitate normal wire cutting without holding the wire.

Figure 4:
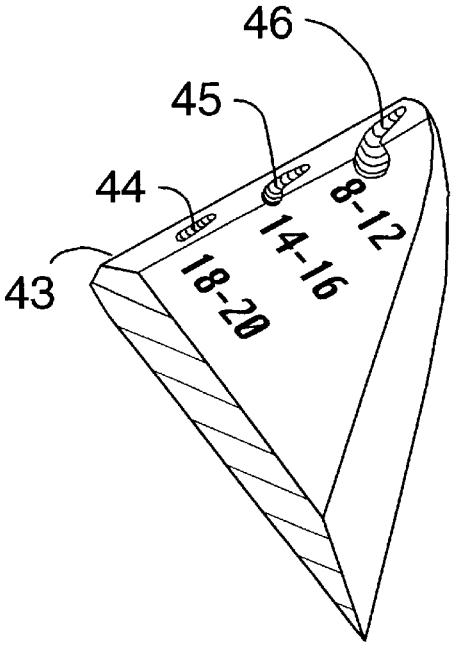

Referring now to FIG. 4, a cutting tool may have a series of cavities 44, 45, 46 along the cutting face 43 thereof which are suitable for use with various sizes of wire. For example, a first cavity 44 could be suitable for wires of sizes 18–20, a second cavity 45 could be suitable for wires of sizes 14–16, and a third cavity 46 could be suitable for wires of sizes 8–12. As shown in FIG. 4, indicia can be embossed or otherwise marked on the tool to guide the user thereof.

Moreover, cavitites all configured for the same size wire may be arranged along a cutting face so that wire may be cut and held anywhere along the cutting edge without looking for a particular location at which to cut the wire. Also, a tool so configured can be used to make successive cuts while holding each cut end in a different location along the cutting face. The cut ends can then be removed after several successive cuts have been made.

Figure 5:
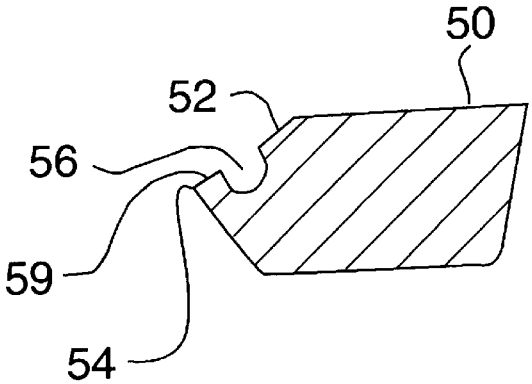
FIG. 5 shows a cross section of a jaw of a wire cutting tool having integral wire holding means in accordance with an embodiment of the present invention.

FIG. 5 shows a cross section of a jaw such as section A—A shown in FIG. 1. Jaw 50 is shown with cutting face 52, cutting edge 54, cavity 56, and isthmus 59. The relative angle of the cutting face 52 at the cutting edge can be modified to optimize performance for a particular application.

An advantage of the present invention over other wire cutters having holding means is that the present invention holds the wire even after the jaws are opened. Presently available devices drop the cut end of the wire when the jaws are opened, thus defeating the purpose of the holding means.

While there has been shown and described what are at present considered the preferred embodiments of the invention, it will be obvious to those skilled in the art that various changes and modifications can be made therein without departing from the scope of the inventions defined by the appended claims.

What is claimed is:

1. A wire cutting tool comprising a jaw defining a cutting edge and at least one cavity disposed in sufficient proximity to said cutting edge so that a wire being cut by said cutting edge is swaged into said cavity and held therein after said wire has been cut, said jaw further defining an isthmus which separates said cavity from said cutting edge.

2. A wire cutting tool in accordance with claim 1 wherein said at least one cavity comprises a series of cavities disposed along said cutting edge for cutting and holding various sizes of wire.

3. A wire cutting tool comprising a first jaw and an opposing second jaw, said second jaw defining a cutting edge and a cavity disposed in sufficient proximity to said cutting edge so that a wire being cut by and between said first jaw and said cutting edge is swaged into said cavity and held therein after said wire has been cut, said jaw further defining an isthmus which separates said cavity from said cutting edge.

4. A wire cutting tool in accordance with claim 3 wherein said cavity is located on a cutting face of said second jaw.

5. A wire cutting tool in accordance with claim 3 wherein said first jaw comprises at least one of the group consisting of a cutting edge and an anvil.

6. A wire cutting tool in accordance with claim 3 wherein said at least one cavity comprises a series of cavities disposed along said cutting edge for cutting and holding various sizes of wire.

* * * * *